US006742578B2

(12) United States Patent
Nakamura

(10) Patent No.: US 6,742,578 B2
(45) Date of Patent: Jun. 1, 2004

(54) HEAT EXCHANGER CORE

(75) Inventor: Youichi Nakamura, Hadano (JP)

(73) Assignee: Toyo Radiator Co., Ltd, Tokyo (JP)

( * ) Notice: Subject to any disclaimer, the term of this patent is extended or adjusted under 35 U.S.C. 154(b) by 18 days.

(21) Appl. No.: 10/115,616

(22) Filed: Apr. 2, 2002

(65) Prior Publication Data

US 2002/0148602 A1 Oct. 17, 2002

(30) Foreign Application Priority Data

Apr. 11, 2001 (JP) ..... 2001-113315

(51) Int. Cl.[7] ..... F28F 3/04
(52) U.S. Cl. ..... 165/165; 165/DIG. 399
(58) Field of Search ..... 165/166, 165, 165/175, 176, DIG. 399, 170, 164

(56) References Cited

U.S. PATENT DOCUMENTS 1,715,378 A * 6/1929 Murray ..... 165/130
2,812,165 A * 11/1957 Hammond ..... 165/166
2,953,110 A * 9/1960 Etheridge ..... 165/165
3,584,682 A * 6/1971 Leedham et al. .. 165/DIG. 399
3,719,227 A * 3/1973 Jenssen ..... 165/166
4,022,050 A * 5/1977 Davis et al. ..... 165/170
4,116,271 A * 9/1978 De Lepeleire ..... 165/166
4,131,159 A * 12/1978 Long ..... 165/166
4,352,393 A * 10/1982 Vidal-Meza ..... 165/166
4,361,184 A * 11/1982 Bengtsson ..... 165/165
4,384,611 A * 5/1983 Fung ..... 165/166
6,032,730 A * 3/2000 Akita et al. ..... 165/166
6,050,329 A * 4/2000 Durian et al. ..... 165/132
6,216,774 B1 * 4/2001 Tsunoda ..... 165/165

* cited by examiner

*Primary Examiner*—Leonard R. Leo
(74) *Attorney, Agent, or Firm*—Jordan and Hamburg LLP

(57) ABSTRACT

Heat exchanger core including flat plate parts formed by alternately folding back a single belt-like metal plate in a zigzag fashion at a first fold-back edge and at a second fold-back edge; element parts formed by joining peripheral edges of a pair of adjoining flat plate parts which are integrally coupled to each other at the first fold-back edge and adjoining element parts are integrally coupled at a certain interval to each other at the second fold-back edge; and a pair of ports for a first fluid formed at positions apart from each other at the peripheral edge of each element part. A second fluid flows along the outer surface side of each element part.

8 Claims, 14 Drawing Sheets

HEAT EXCHANGER CORE

BACKGROUND OF THE INVENTION

1. Field of the Invention

The present invention relates to a heat exchanger core of a plate type which joins the peripheral edges of a pair of metal plates to make up an element part.

2. Description of the Related Art

A conventional plate-type heat exchanger core has been completed by bending an elongated metal plate by press working to form a multiplicity of recessed and raised portions or corrugated portions on the surface, preparing a pair of plates each having ports formed at both ends in the longitudinal direction, joining the peripheral portions of the pair of plates by brazing or welding to make up elements, and coupling the elements at their ports with each other in a liquid-tight manner.

Inconveniently, such a plate-type heat exchanger has necessitated a large number of plates resulting in an increase of the number of the constituent parts, and troublesome and time-consuming assembly.

In addition, the brazing or welding had to be effected along the full peripheral edges of the plate, resulting in an increased number of joints, which may often cause any leaks.

SUMMARY OF THE INVENTION

It is therefore the object of the present invention to solve the above problem.

According to a first aspect of the present invention there is provided a heat exchanger core comprising a multiplicity of flat plate parts formed by alternately folding back a single belt-like metal plate in zigzag at a first fold-back edge and at a second fold-back edge; a plurality of element parts formed by joining peripheral edges of a pair of adjoining flat plate parts which are integrally coupled to each other at the first fold-back edge, adjoining ones of the plurality of element parts being integrally coupled at a certain interval to each other at the second fold-back edge; and a pair of ports for a first fluid formed at positions apart from each other at the peripheral edge of each of the plurality of element parts, wherein a second fluid flows through the outer surface side of the plurality of element parts.

The planar surface of each of the multiplicity of flat plate parts is preferably bent into a corrugation, with the pair of ports of each element part being formed at the second fold-back edge.

Preferably, the heat exchanger core further comprises a manifold part associated with the ports, the manifold part extending from the second fold-back edge to the first fold-back edge or its vicinity.

The manifold part may be bent into a corrugation such that the amplitude of the corrugation is smaller than the amplitude of corrugations of the other parts.

The planar surface of each of the multiplicity of flat plate parts may be bent into a corrugation, with one of the pair of ports of each element part being formed at the second fold-back edge, with the other of the pair of ports being formed at the edge of a side orthogonal to the side thereof.

According to a second aspect of the present invention there is provided a heat exchanger core comprising a multiplicity of flat plate parts formed by alternately folding back a single belt-like metal plate in zigzag at a first fold-back edge and at a second fold-back edge; a plurality of element parts formed by joining peripheral edges of a pair of adjoining flat plate parts which are integrally coupled to each other at the first fold-back edge, adjoining ones of the plurality of element parts being integrally coupled at a certain interval to each other at the second fold-back edge; and a pair of ports for a first fluid formed at positions apart from each other on the planar surface of each element part, the pair of ports of each element part being connected to each other such that the pair of ports communicate with each other in the thickness direction, wherein a second fluid flows through the outer surface side of the plurality of element parts.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

Preferred embodiments of the present invention will now be described with reference to the accompanying drawings.

Figure 1:
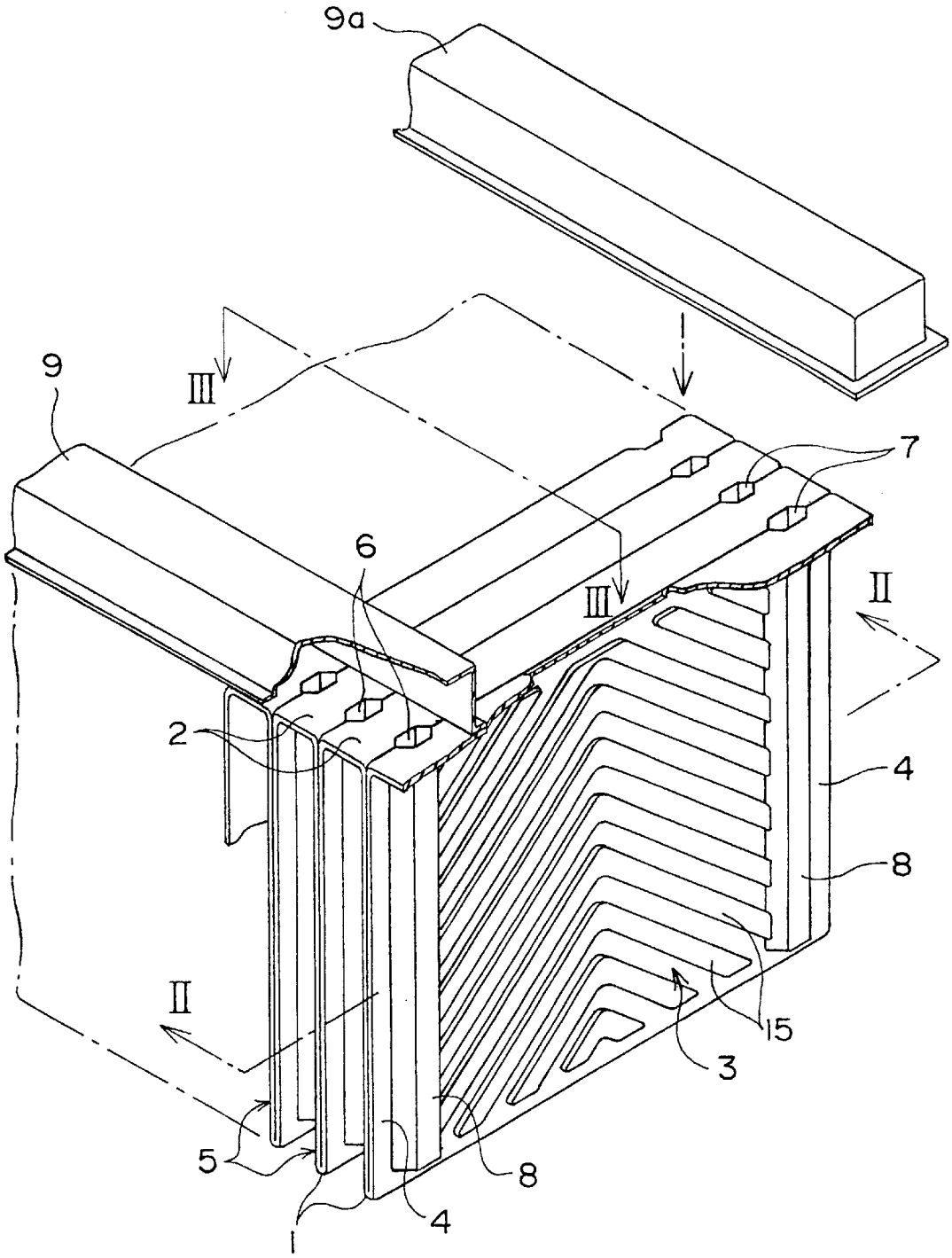
FIG. 1 is a partly cut-away perspective explanatory view of the major part of a heat exchanger core in accordance with a first embodiment of the present invention.
Figure 2:
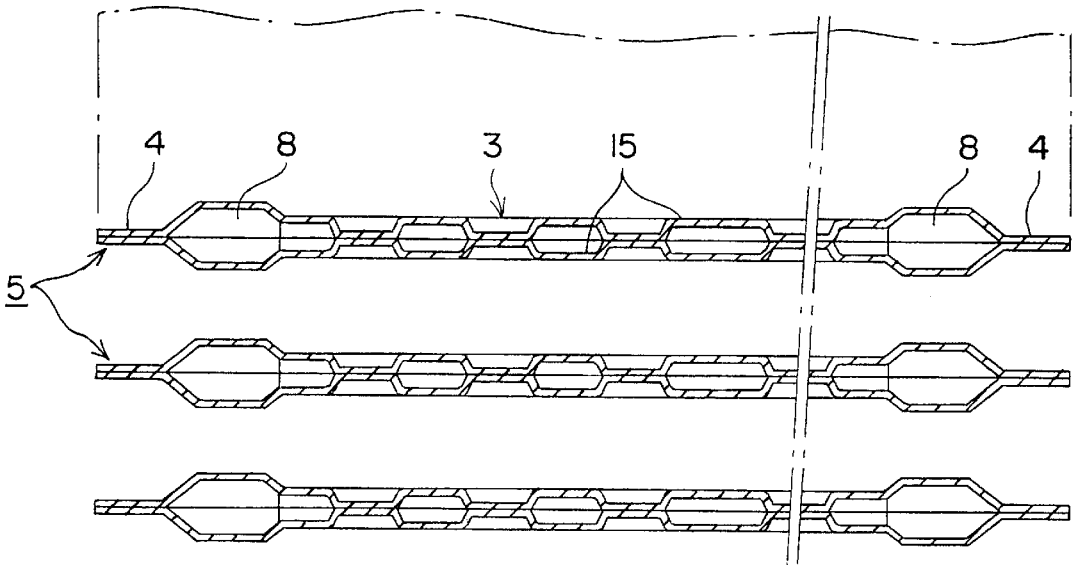
FIG. 2 is a sectional view taken along line II—II of FIG. 1.
Figure 3:
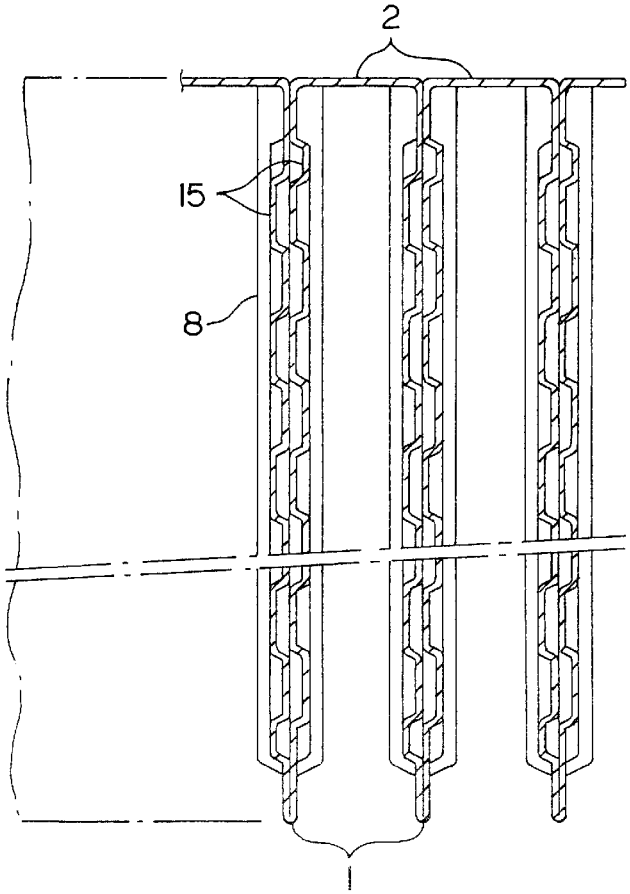
FIG. 3 is a sectional view taken along line III—III of FIG. 1.
Figure 4:
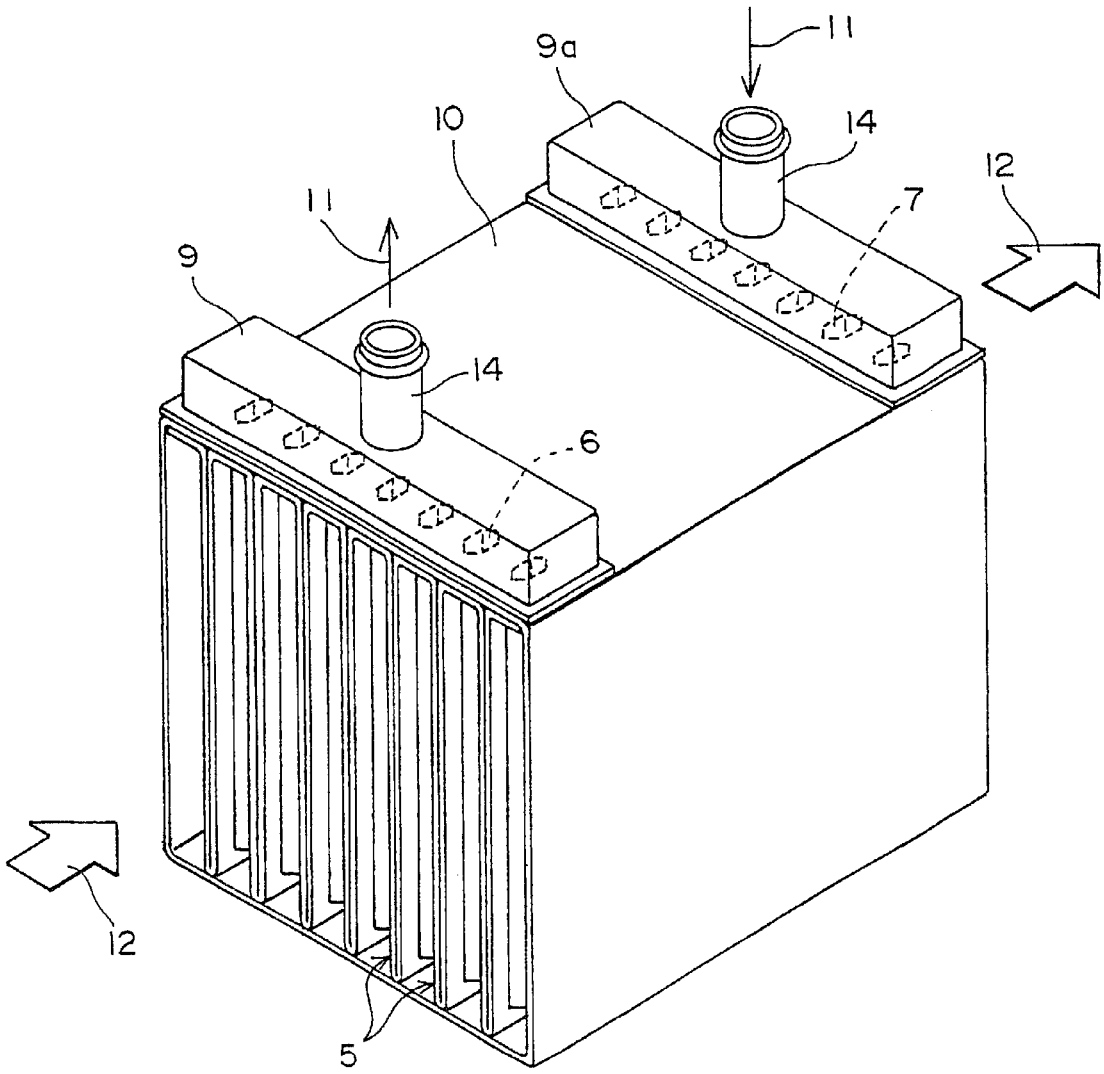
FIG. 4 is a schematic perspective view of the heat exchanger using the heat exchanger core.

FIGS. 1 to 4 illustrate a first embodiment of the present invention. FIG. 1 is a partly cut-away perspective view for explaining the principal part, FIG. 2 is a sectional view taken along line II—II of FIG. 1, FIG. 3 is a sectional view taken along line III—III of FIG. 1, and FIG. 4 is a perspective view of a heat exchanger using a heat exchanger core.

The heat exchanger core comprises as shown in FIG. 1 a flat plate part 3 in the form of a single belt-like metal plate, a corrugated bent part 15 previously bendingly formed on the flat plate part 3, and a manifold part 8 bendingly formed at opposite ends thereof in the width direction. The corrugated bent part 15 consists of a multiplicity of groove-shaped recesses which are formed in crest in plan on the inner side of an element part 5. Peripheral edges 4 of the flat plate part 3 are formed with a flanged part free from the corrugated bent part 15. The flanged portion is then folded back in zigzag at a first fold-back edge 1 and a second fold-back edge 2 which are located at upper and lower positions, respectively, in the diagram.

This allows a multiplicity of flat plate parts 3 to be formed, with the peripheral edges 4 of a pair of integrally coupled, adjoining flat plate parts 3 being joined together by brazing or welding at the first fold-back, to thereby form a plurality of element parts 5. In addition, the adjoining element parts 5 are integrally coupled at certain intervals at the second fold-back edge 2, to form ports 6 and 7 at the upper end of the manifold 8.

Incidentally, the corrugated bent parts 15 on the confronting plates are arranged such that their crests in plan are opposite to each other, to thereby allow a multiplicity of grooves and ridges of the confronting corrugations to cross each other.

A pair of tank bodies 9 and 9*a* are fitted to opposite sides of the upper end of the heat exchanger core thus constructed. In addition, a casing 10 is fitted to the outer periphery of the core as shown in FIG. 4. It is to be noted that openings are formed in the top surface of the casing 10 so as to be in registration with the ports 6 and 7 of each element part 5.

In the thus constructed heat exchanger, a first fluid 11 flows in through a pipe 14 of the tank body 9*a* on one hand, flows into the multiplicity of grooved portions of each corrugated bent part 15 by way of the port 7 of each element part and through the manifold part 8, moves in zigzag between the grooved portions of the confronting flat plate parts 3, and flows out through the manifold part 8 on the other and the port 6 from the tank body 9 on the other into the pipe 14. At the same time, as seen in FIG. 4, a second fluid 12 flows from one opening side of the casing 10 to the outer surface side of the element part 5 and flows out from the opening on the other of the casing 10. A heat exchange is thus effected between the first fluid 11 and the second fluid 12.

Although in FIG. 1 of this example the corrugated bent part 15 is formed with a multiplicity of ridges and groove portions, instead a multiplicity of parallel extending grooves and ridges may internally be formed which are diagonally inclined from the manifold part 8 on one hand toward the manifold part 8 on the other. In this event, the grooves in the confronting flat surfaces are arranged such that they cross each other. Alternatively, the corrugated bent part 15 may be formed such that the grooves and ridges form a gentle corrugation on the flat surface. In this event as well, the grooves in the confronting flat surfaces are arranged such that their waves cross each other.

Figure 5:
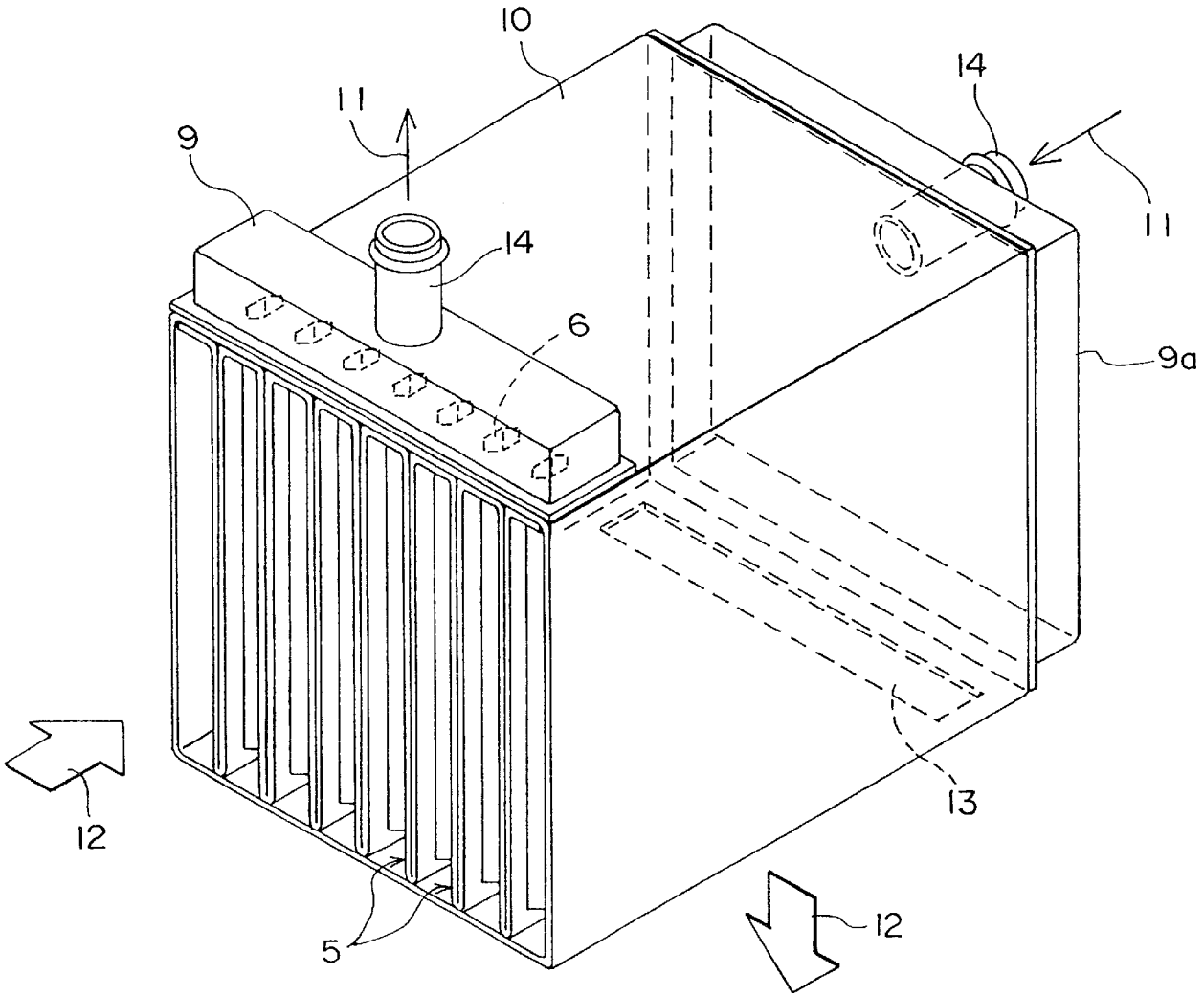
FIG. 5 is a schematic perspective view of a heat exchanger core in accordance with a second embodiment of the present invention.
Figure 6:
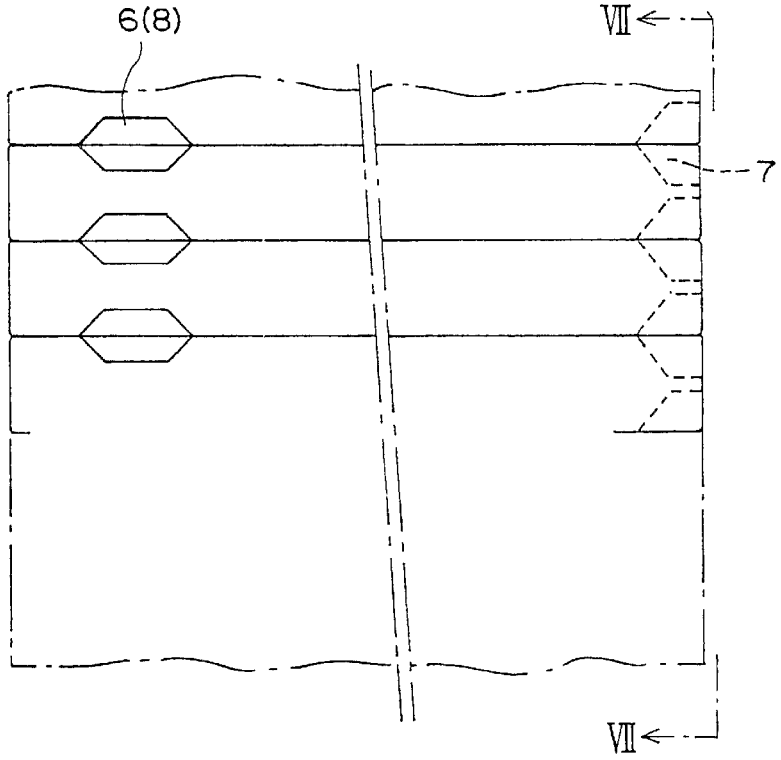
FIG. 6 is a top plan view of the heat exchanger core.
Figure 7:
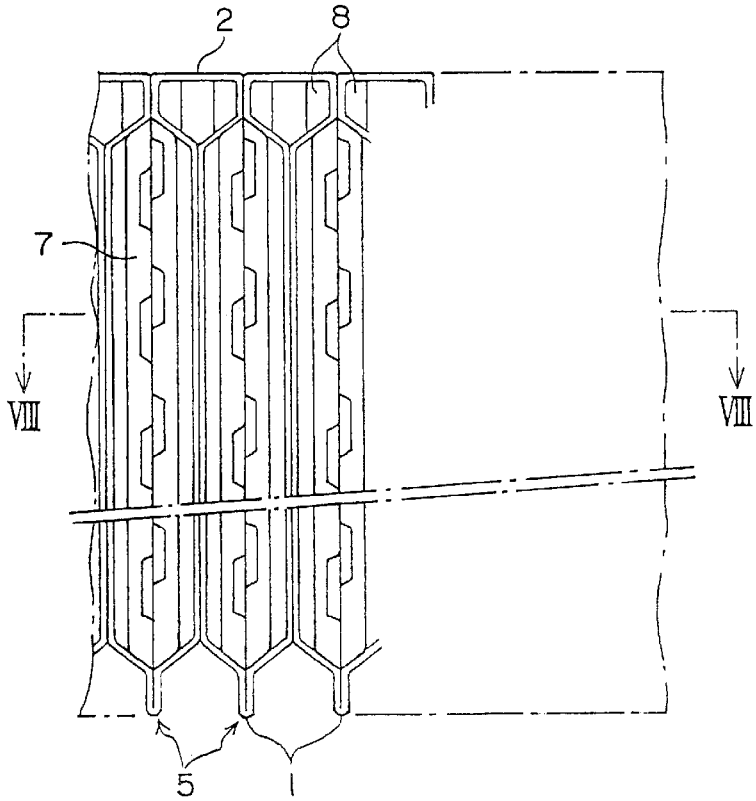
FIG. 7 is a diagram viewed from line VII—VII of FIG. 6.
Figure 8:
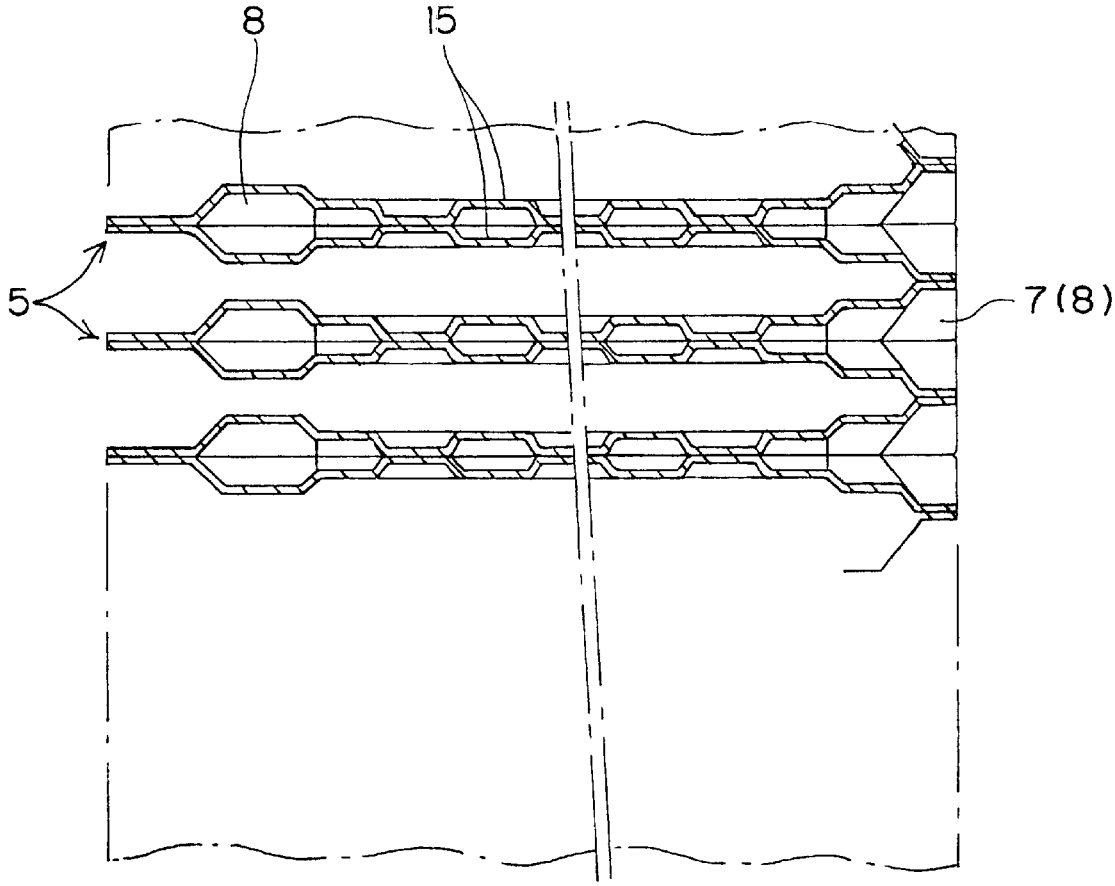
FIG. 8 is a sectional view taken along line VIII—VIII of FIG. 7.

FIG. 5 illustrates a heat exchanger using a heat exchanger core in accordance with a second embodiment of the present invention, FIG. 6 shows the top surface side of the core, FIG. 7 is a diagram viewed from line VII—VII of FIG. 6, and FIG. 8 is a sectional view taken along line VIII—VIII of FIG. 7.

In the heat exchanger core of this example, as shown in FIG. 6, a port 6 is formed at one end of the top surface of each element part 5, with a port 6 being formed at one end of the side surface. As seen in FIG. 5, a tank body 9 is fitted to the port 6 in the top surface and a tank body 9*a* is fitted to the side surface. It is to be noted that the gaps defined between the adjacent element parts in the side are blocked by an inner flanged part not shown formed at the edge of the tank body 9*a*. The tank bodies 9 and 9*a* are each projectingly provided with a pipe 14. The side end portions of the bottom surface of the casing 10 are provided with an elongated opening 13. A first fluid 11 flows in through the pipe 14 associated with the tank body 9*a* on the side of FIG. 5, moves from right to left through the element parts 5, and flows out from the ports 6 in the top surface via the tank body 9 through the pipe 14. A second fluid 12 flows from the opening on one hand of the casing 10, and flows out of the opening 13 in the intersecting surfaces, to thereby effect a heat exchange therebetween.

Figure 9:
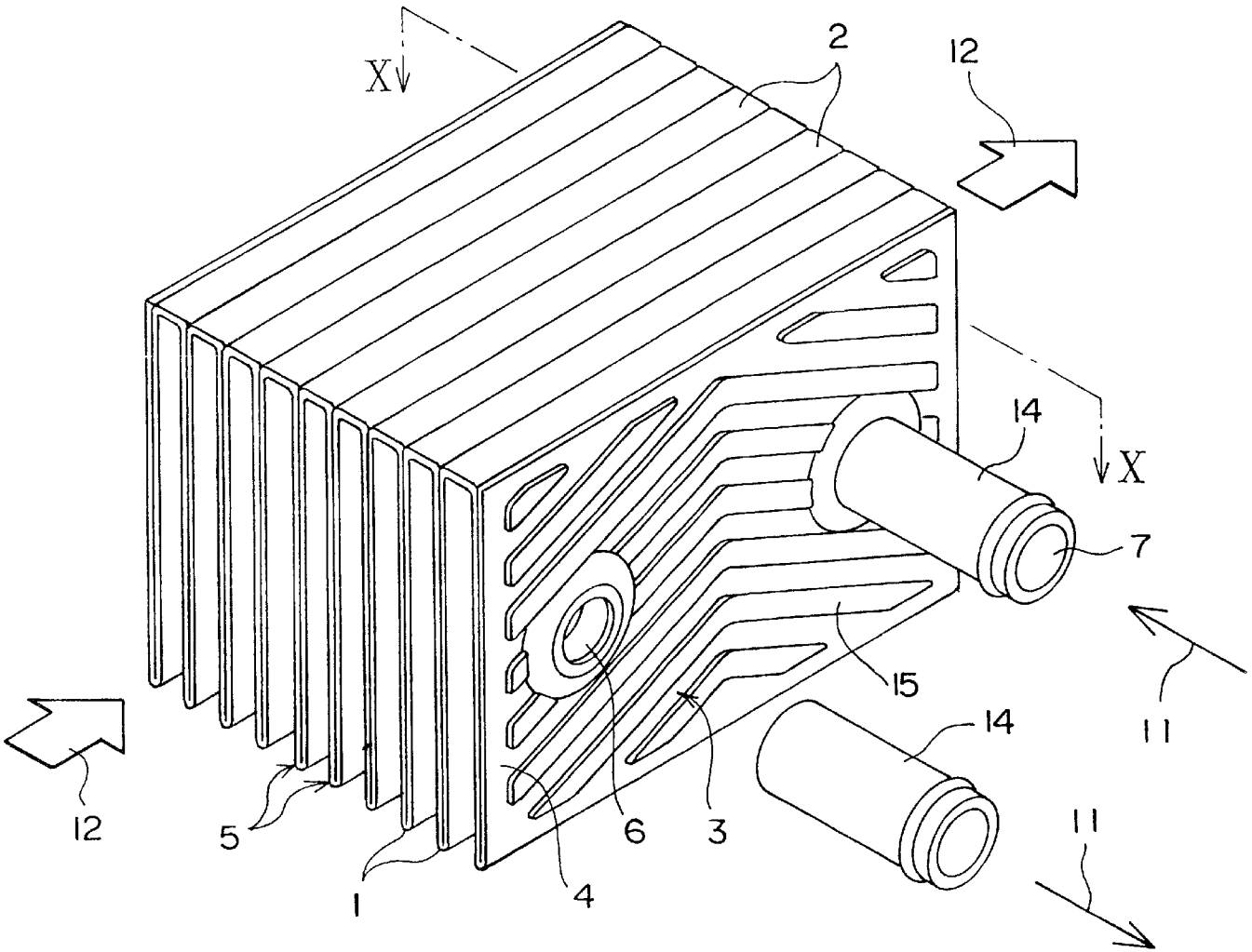
FIG. 9 is a schematic perspective view of a heat exchanger core in accordance with a third embodiment of the present invention.
Figure 10:
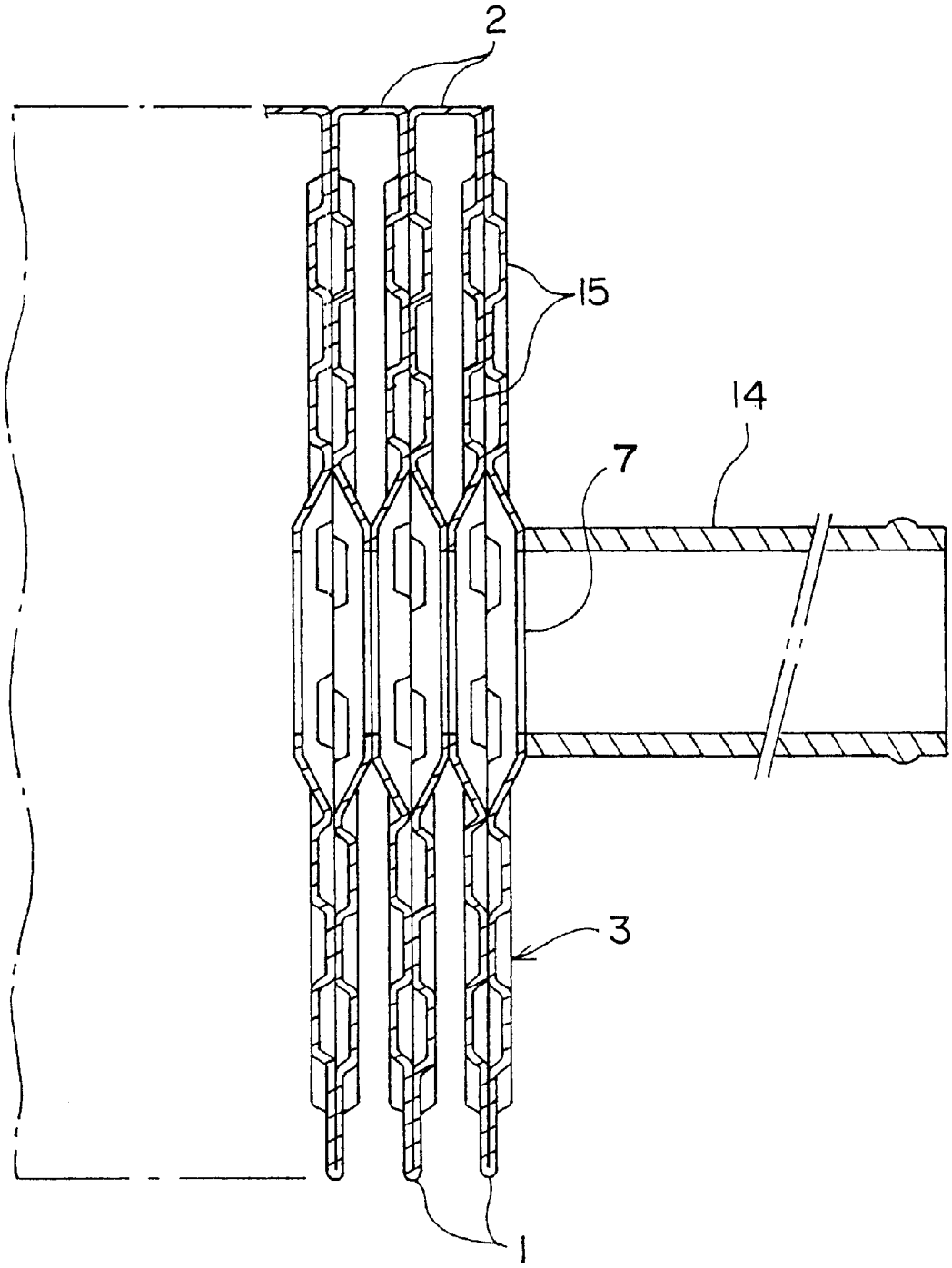
FIG. 10 is a sectional view taken along line X—X of FIG. 9.

FIG. 9 illustrates a heat exchanger core in accordance with a third embodiment of the present invention, and FIG. 10 is a diagram viewed from line X—X of FIG. 9. In this example, a pair of ports 6 and 7 are formed at both end portions of the flat plate part 3, with their opening edges bulging outward to allow the ports 6 and 7 to communicate with each other as shown in FIG. 10. A pair of pipes 14 are joined at their end portions to the ports 6 and 7. A first fluid 11 flows in through the pipe 14 on one hand, moves from right to left through the element parts 5, and is led from the port 6 on the other via the pipe 14 on the other to the exterior. A second fluid 12 flows to the external surface side of the element parts 5.

Figure 11:
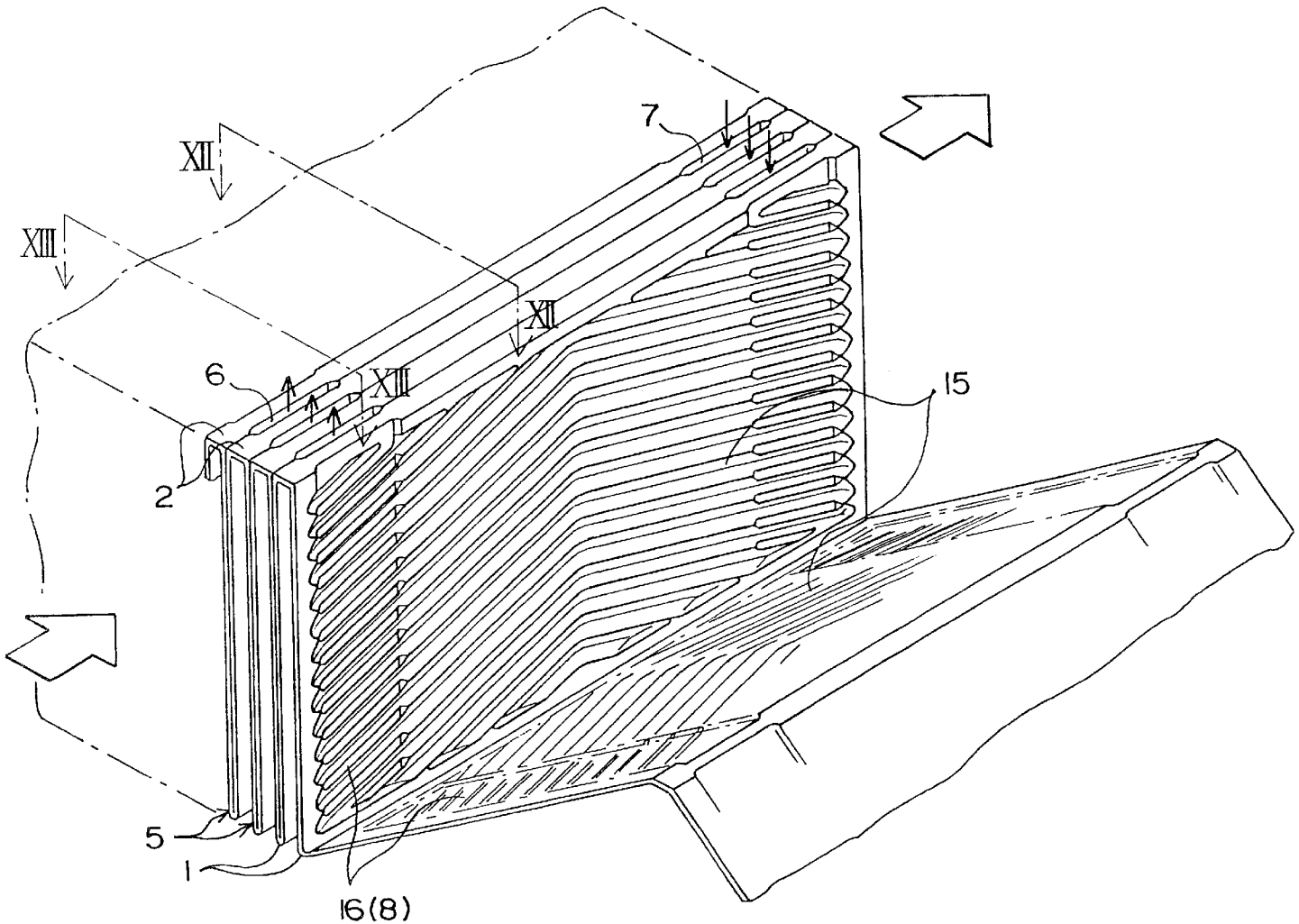
FIG. 11 is a partly developed perspective view of a heat exchanger core in accordance with a fourth embodiment of the present invention.
Figure 12:
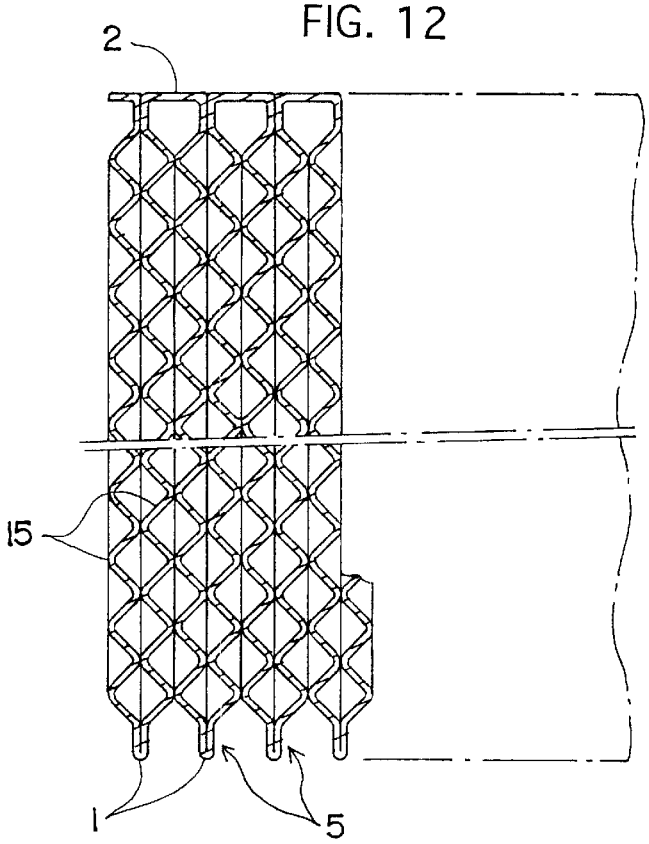
FIG. 12 is a sectional view taken along line XII—XII of FIG. 11.
Figure 13:
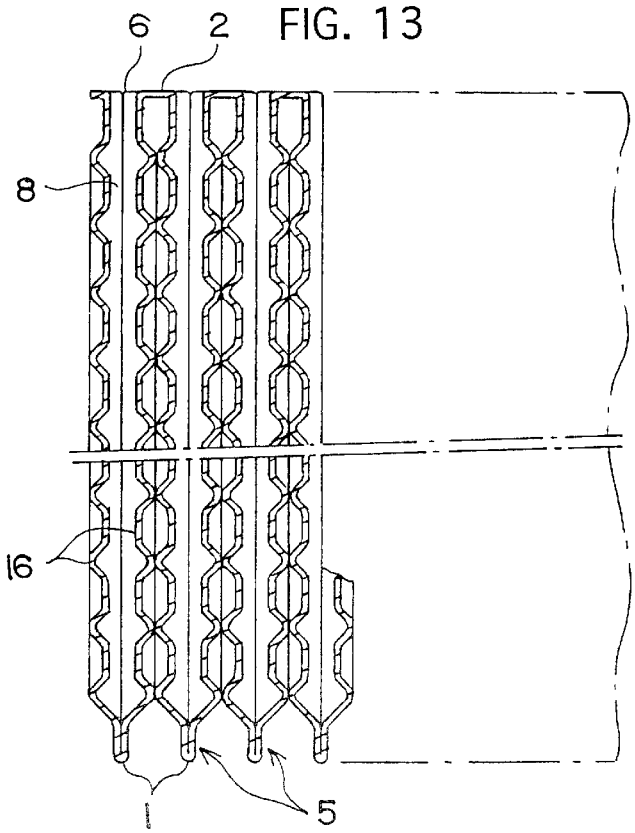
FIG. 13 is a sectional view taken along line XIII—XIII of FIG. 11.

FIGS. 11, 12 and 13 illustrate a heat exchanger core in accordance with a fourth embodiment of the present invention. This embodiment differs from the first embodiment in that the external surfaces of the adjoining element parts 5 are in back-to-back contact and in that the manifold part 8 communicating with the ports 6 and 7 is provided with an auxiliary corrugated bent part 16. Thus, as shown in FIG. 12, external surfaces of the corrugated bent parts 15 of adjoining element parts 5 are in back-to-back contact with one another and as shown in FIG. 13, external surfaces of the auxiliary corrugated bent parts 16 of adjoining element parts 5 are in back-to-back contact with one another. The auxiliary corrugated bent part 16 as shown in FIG. 13 has a lower protrusion on its inner surface side to thereby provide the manifold part 8.

Figure 14:
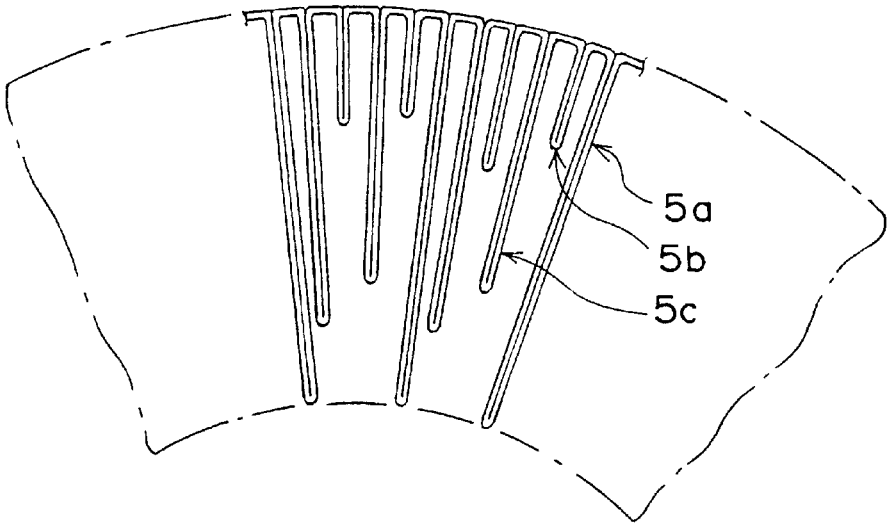
FIG. 14 is a schematic side elevation of a heat exchanger core in accordance with a fifth embodiment of the present invention.

FIG. 14 is a schematic side elevation of a heat exchanger core in accordance with a fifth embodiment of the present invention, in which the core has adjoining element parts 5*a*, 5*b* and 5*c* which are different in length. In addition, their respective flat portions are gradually inclined so as to form a generally tubular or arcuate core. FIG. 14 schematically shows, as a further embodiment, the surface corresponding to the left side surface of the embodiment of FIG. 1.

Figure 15:
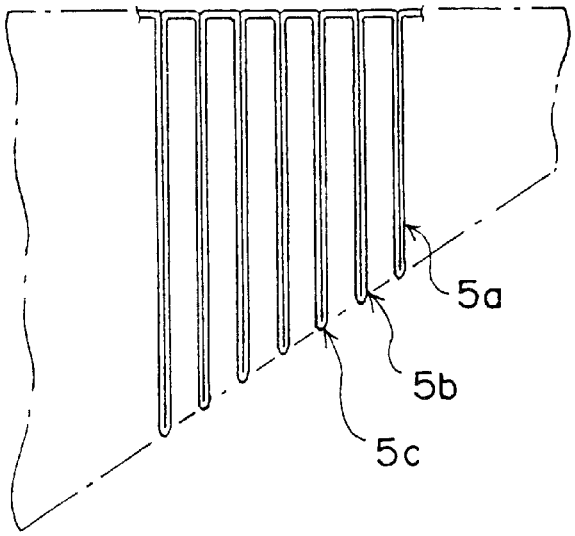
FIG. 15 is a schematic side elevation of a heat exchanger core in accordance with a sixth embodiment of the present invention.

Similarly, FIG. 15 is a schematic side elevation of a heat exchanger core in accordance with a sixth embodiment of the present invention, in which the core has the element parts 5*a*, 5*b* and 5*c* whose lengths become longer in the mentioned order. The embodiment is applicable to the case where such a shape is given to the cross section of the space in which the heat exchanger core is arranged.

Figure 16:
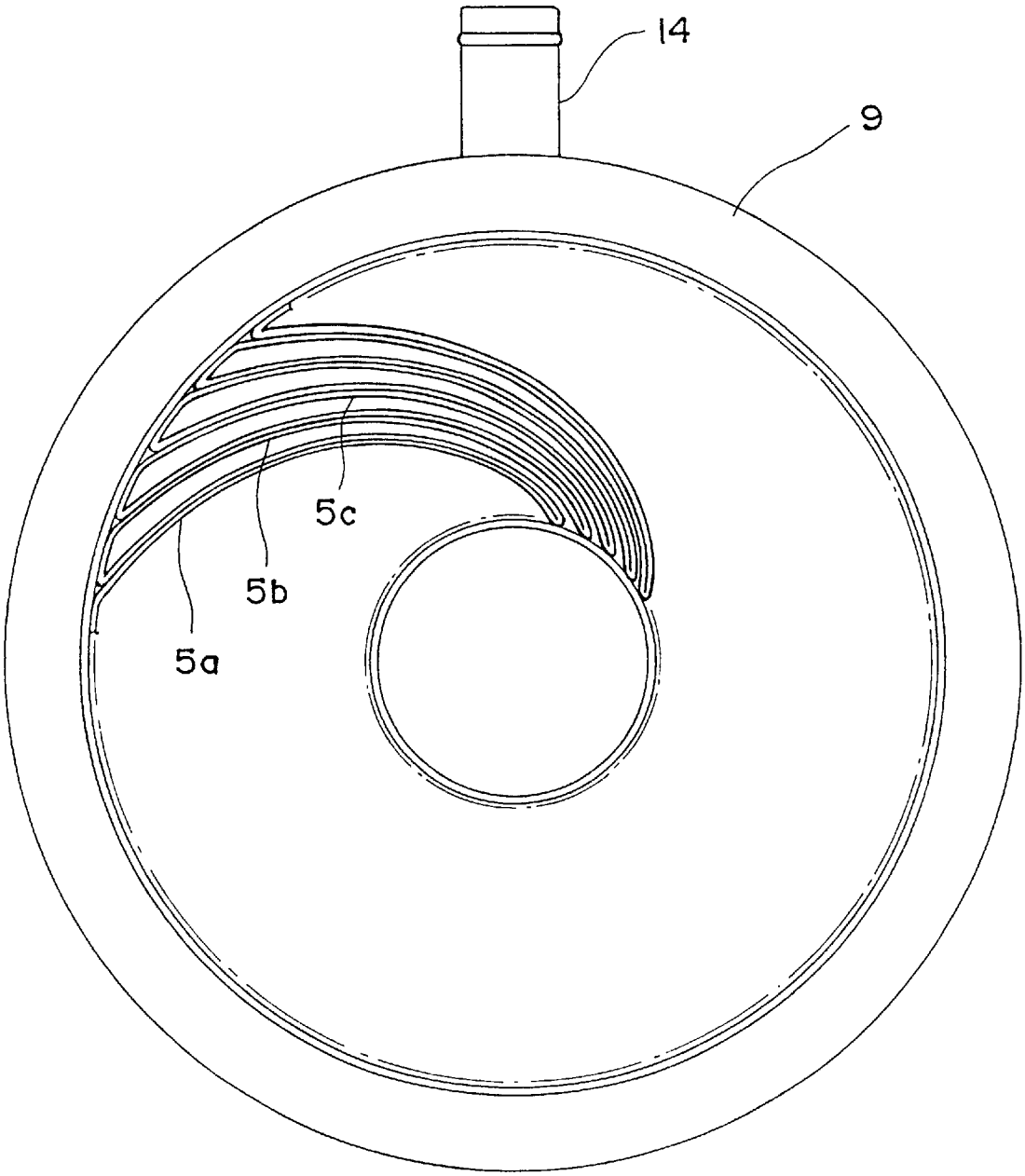
FIG. 16 is a schematic side elevation of a heat exchanger core in accordance with a seventh embodiment of the present invention.

Similarly, FIG. 16 is a schematic side elevation of a heat exchanger core in accordance with a seventh embodiment of the present invention, in which the element parts 5*a*, 5*b* and 5*c* are formed arcuately having a generally spiral side surface. This embodiment is a modification of FIG. 1 version, in which the flat surfaces of the element parts 5 are substantially arcuately and radially deformed with its entirety being twisted around its axis. The ports for the first fluid remain as they are and the tank body 9(9*a*) is formed circularly in side so as to be conform with the external periphery of the core.

Figure 17:
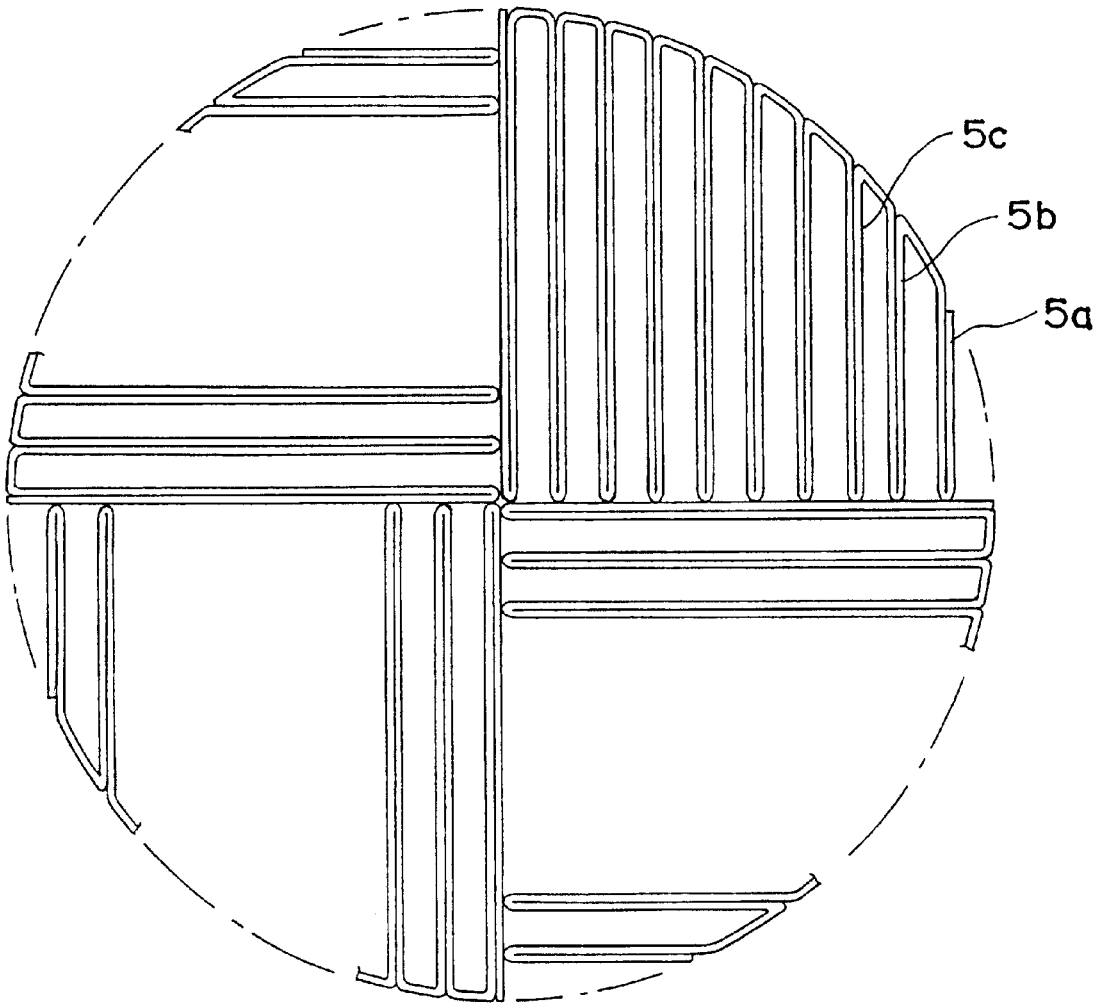
FIG. 17 is a schematic side elevation of a heat exchanger core in accordance with an eighth embodiment of the present invention.

Similarly, FIG. 17 is a schematic side elevation of a heat exchanger core in accordance with an eighth embodiment of the present invention, in which four cores are arranged at right angles relative to each other so as to present a generally circular side surface. The cores have the element parts 5*a*, 5*b* and 5*c* whose lengths become longer in series along the quarter circle.

Figure 18:
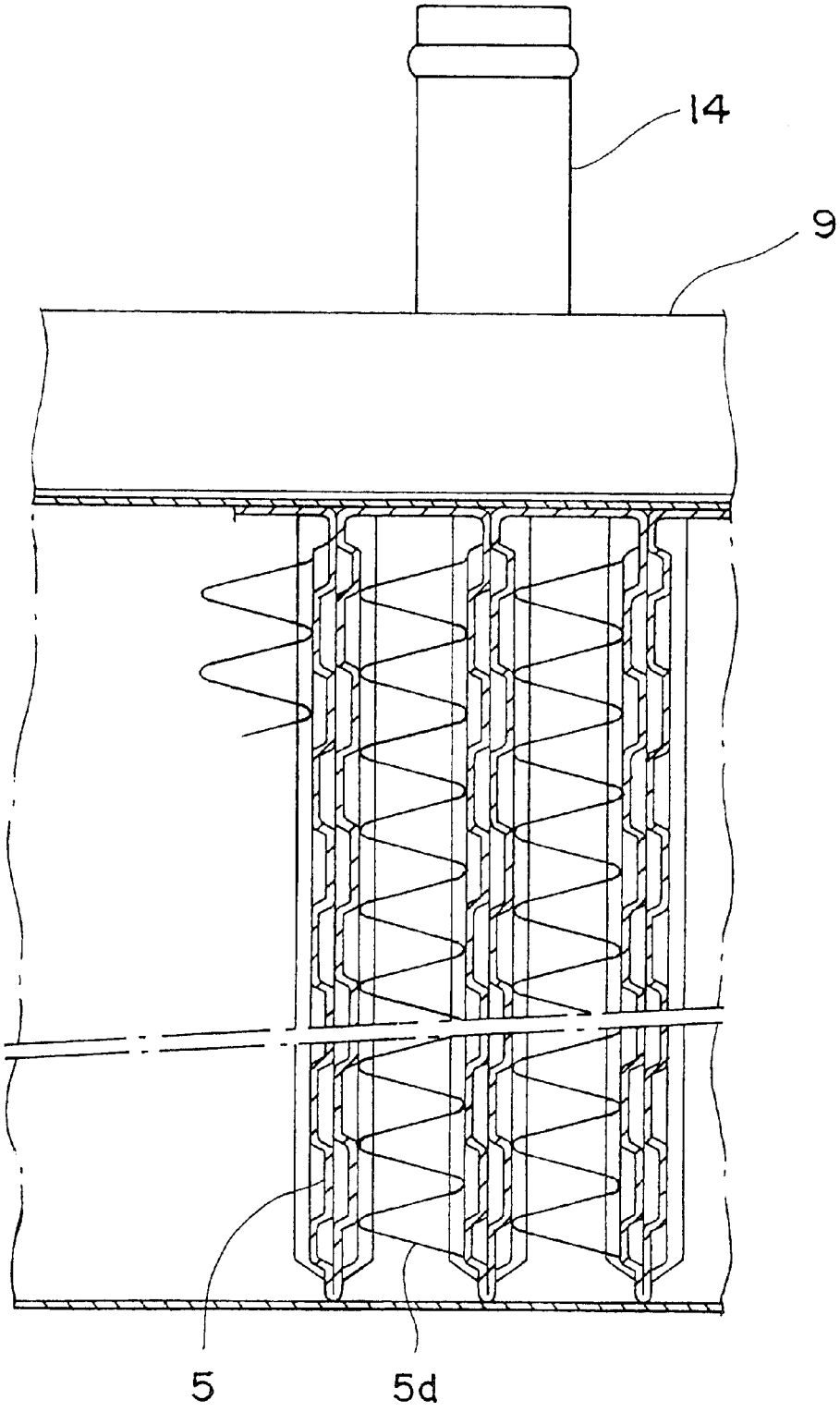
FIG. 18 is a schematic side elevation of a heat exchanger core in accordance with a ninth embodiment of the present invention.

FIG. 18 is a schematic side elevation of a heat exchanger core in accordance with a ninth embodiment of the present invention, which corresponds to FIG. 3 showing the first embodiment but further comprises the casing and the tank body 9 added thereto. In this embodiment, an outer fin 5*d* is arranged between the external surfaces of the adjoining element parts 5. The outer fin can be an offset type fin or a corrugated fin.

Since the heat exchanger core of the present invention is obtained by folding back a single belt-like metal plate in zigzag to thereby form a plurality of element parts 5, it is possible to reduce the number of joints by brazing or welding and the number of components and hence provide a leak-suppressed heat exchanger core at low costs.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A heat exchanger core comprising:

plurality of flat plate parts formed by alternately folding back a single belt-like metal plate in a zigzag fashion at a first fold-back edge and at a second fold-back edge;

a plurality of element parts formed by joining peripheral edges of a pair of adjoining flat plate parts which are integrally coupled to each other at said first fold-back edge, adjoining ones of said plurality of element parts being integrally coupled at a certain interval to each other at said second fold-back edge;

a pair of ports for a first fluid formed at positions apart from each other at the peripheral edge of each of said plurality of element parts, wherein a second fluid flows over an outer surface side of said plurality of element parts and a planar surface of each of said plurality of flat plate parts is bent into a corrugation to form a corrugated bent part, with said pair of ports of each element part being formed at said second fold-back edge, external surfaces of said corrugated bent parts of adjoining element parts being in back-to-back contact with one another; and a manifold part associated with said ports, said manifold part extending from said second fold-back edge to said first fold-back edge or its vicinity, said manifold part being bent into a corrugation to form auxiliary corrugated bent parts and such that the amplitude of said corrugation is smaller than the amplitude of corrugations of the other parts, external surfaces of said auxiliary corrugated bent parts of adjoining element parts being in back-to-back contact with one another.

2. The heat exchanger core according to claim 1, wherein said elements parts are generally parallel to one another proximate said first fold-back edge.

3. The heat exchanger core according to claim 1, wherein said elements parts are generally parallel to one another proximate said second fold-back edge.

4. The heat exchanger core according to claim 1, wherein said corrugated bent parts include a plurality of groove-shaped recesses.

5. The heat exchanger core according to claim 4, wherein said groove-shaped recesses are formed to crest on an inner side of said element parts.

6. The heat exchanger core according to claim 1, wherein said first fold-back edge is at an upper position and said second fold-back edge is at a lower position.

7. The heat exchanger core according to claim 1, wherein said manifold part extends from said second fold-back edge to said first fold-back edge.

8. The heat exchanger core according to claim 1, wherein said manifold part extends from said second fold-back edge to the vicinity of said first fold-back edge.

* * * * *